US011849824B1

(12) United States Patent
Lehtonen

(10) Patent No.: US 11,849,824 B1
(45) Date of Patent: Dec. 26, 2023

(54) PROTECTIVE WRAP SYSTEM FOR PURSE HANDLES

(71) Applicant: NO SACRIFICE BAGS INC., King (CA)

(72) Inventor: Donna Lee Elizabeth Lehtonen, Schomberg (CA)

(73) Assignee: NO SACRIFICE BAGS INC., King (CA)

( * ) Notice: Subject to any disclaimer, the term of this patent is extended or adjusted under 35 U.S.C. 154(b) by 0 days.

(21) Appl. No.: 18/104,546

(22) Filed: Feb. 1, 2023

Related U.S. Application Data

(63) Continuation of application No. 17/964,546, filed on Oct. 12, 2022, now Pat. No. 11,607,022.

(51) Int. Cl.
*A45C 13/00* (2006.01)
*A45C 13/26* (2006.01)

(52) U.S. Cl.
CPC ..... *A45C 13/002* (2013.01); *A45C 13/26* (2013.01)

(58) Field of Classification Search
CPC ..... A45C 13/002; A45C 13/26
USPC ..... 294/171; 428/192; 16/422, 114.1
See application file for complete search history.

(56) References Cited

U.S. PATENT DOCUMENTS 96,889 A 11/1869 Covell
645,670 A * 3/1900 Ottignon ..... A45F 5/1046 220/759
1,268,775 A * 6/1918 Stanger ..... A45F 5/1046 220/759
1,691,467 A * 11/1928 Carver ..... A45F 5/1026 294/170
2,274,605 A 2/1942 Hoffmeister
2,717,411 A * 9/1955 Taipale ..... A45F 5/1046 294/171
3,030,685 A 4/1962 Reiter
3,800,361 A 4/1974 Stauffer
4,902,060 A 2/1990 Nobakht
D312,370 S 11/1990 Weed
D315,285 S 3/1991 Workman
5,257,845 A 11/1993 McConnell
(Continued)

FOREIGN PATENT DOCUMENTS

CA 2921341 A1 10/2014
KR 301178161.0000 8/2022

OTHER PUBLICATIONS

U.S. Appl. No. 13/947,983, filed Jul. 22, 2013, not yet published.
(Continued)

*Primary Examiner* — John K Fristoe, Jr.
*Assistant Examiner* — Justin Caudill
(74) *Attorney, Agent, or Firm* — Kintner IP, LLC; Mary Frances Ludwig

(57) ABSTRACT

A protective wrap system protects the handles of a purse or other bag and provides a gripping surface to resist tendency of the purse to slip when supported by the handles. The system includes a wrap configured to wrap around a purse handle and a grip that couples to the wrap and is positioned outside the wrap on the underside of the handle. The system provides protection to the handles from contact with a user's hand or other surface. The system further provides a gripping surface configured to grip a contoured surface without damaging or leaving residue on the surface.

13 Claims, 8 Drawing Sheets

(56) References Cited

U.S. PATENT DOCUMENTS

| | | | | |
|---|---|---|---|---|
| 5,738,401 | A * | 4/1998 | Fan | A45F 5/1046 294/171 |
| D394,956 | S | 6/1998 | Fruecht | |
| 5,803,522 | A | 9/1998 | Lisbon | |
| 5,865,494 | A | 2/1999 | Tipp | |
| D410,779 | S | 6/1999 | Hannah | |
| D411,093 | S | 6/1999 | Selig et al. | |
| D417,787 | S | 12/1999 | Wathne et al. | |
| 6,049,948 | A | 4/2000 | Leonardi | |
| D428,334 | S | 7/2000 | Serfaty | |
| D435,732 | S | 1/2001 | Della Valle | |
| D442,085 | S | 5/2001 | Bozlee | |
| D448,663 | S | 10/2001 | Raftree | |
| 6,357,568 | B1 | 3/2002 | Chen | |
| 6,378,925 | B1 | 4/2002 | Greenlee | |
| 6,796,002 | B2 | 9/2004 | Beckwith | |
| D503,109 | S | 3/2005 | Burr et al. | |
| D532,972 | S | 12/2006 | Dixon | |
| D636,603 | S | 4/2011 | Cartwright | |
| D714,639 | S | 10/2014 | Royer et al. | |
| 9,162,354 | B1 | 10/2015 | Wang | |
| D801,694 | S | 11/2017 | Burgess | |
| D813,487 | S | 3/2018 | Eskridge | |
| D831,356 | S | 10/2018 | Ryan | |
| D835,989 | S | 12/2018 | Racovalis | |
| D848,744 | S | 5/2019 | Axelbaum | |
| D889,842 | S | 7/2020 | Hargraves | |
| D894,606 | S | 9/2020 | Lehtonen | |
| D956,357 | S | 6/2022 | Ahlberg et al. | |
| 2001/0000938 | A1* | 5/2001 | Bozlee | A45F 5/1046 294/171 |
| 2003/0135954 | A1* | 7/2003 | Beckwith | A45C 13/26 16/422 |
| 2005/0285421 | A1* | 12/2005 | Novakovich | A45F 5/1046 294/171 |
| 2007/0000089 | A1 | 1/2007 | Morales | |
| 2008/0061574 | A1 | 3/2008 | Seki | |
| 2008/0217369 | A1 | 9/2008 | Sloot | |
| 2008/0303230 | A1 | 12/2008 | Somberg | |
| 2009/0183299 | A1 | 7/2009 | Conway | |
| 2010/0029175 | A1 | 2/2010 | Ponicall | |
| 2012/0108403 | A1 | 5/2012 | Zandman-Zeman et al. | |
| 2013/0230679 | A1 | 9/2013 | Czerniel et al. | |
| 2014/0302287 | A1 | 10/2014 | Lehthonen | |
| 2015/0257518 | A1* | 9/2015 | Burkman | A45F 5/1046 294/171 |
| 2015/0320191 | A1 | 11/2015 | Stevens | |
| 2016/0345698 | A1* | 12/2016 | Beqaj | A45C 13/26 |

OTHER PUBLICATIONS

Amazon, "Shoulder Houlder Purse Strap Holder" https://www.amazon.com/Shoulder-Houlder-Purse-Strap-Holder/dp/B004AR99QK, 2010pp. 1-5.

Madison Avenue Couture, "Everything You Need to Know About the Hermes Twilly", https://madisonavenuecouture.com/blogs/news/everything-you-need-to-know-about-the-hermes-twilly, 2018, pp. 1-2.

Economy Single Ply Travel Grip W/Id Panel, Wholesale China Economy Single Ply Trael Grip W/Id Panel 2003-2015, available in the IFW of U.S. Appl. No. 13/947,983.

Soft-Grip Gel Luggage Case Marker Handle Wrap—2007.

Handle wrap love handles, posted at etsy.com, first available Jun. 24, 2017, retrieved on Feb. 16, 2023, online, https://www.etsy.com/listing/159635378/handle-wrap-love-handles-patented (Year: 2017).

Love handles, posted at amazon.com, first available Jun. 21, 2018, retrieved on Feb. 16, 2023, online, https://www.amazon.com/Handles-Protectors-Protection-Available-Multiple/dp/B07DX84Q9M (Year: 2018).

Neoprene shoulder strap pads, posted at amazon.com, first available Jun. 12, 2017, retrieved on Feb. 16, 2023, online, https://www.amazon.com/Neoprene-Comfortable-Replacement-Shoulder-Backpack/dp/B072N 17XDG (Year: 2017).

Oulario leather handle protector, posted at amazon.com, first available Sep. 28, 2020, retrieved on Feb. 16, 2023, online, https://www.amazon.com/OULARIO-Protector-Compatible-Neverfull-Shoulder/dp/B08 KS L2CW7 (Year: 2020).

Aprikot Handle Cover Wrap, posted at amazon.com, first available Apr. 14, 2021, retrieved on Feb. 24, 2023, online, https://www.amazon.com/Handle-Cover-Purses-Designer-Brown/dp/B092KPPKZN (Year: 2021).

New Love Handles, posted at nosacrificebags.com, first available 2023, retrieved on Feb. 24, 2023, online, https://nosacrificebags.com/products/new-love-handles-full-coverage-protection-for-speedy-30-handles (Year: 2023).

* cited by examiner

PROTECTIVE WRAP SYSTEM FOR PURSE HANDLES

CROSS REFERENCE TO RELATED APPLICATION

This application is a continuation of U.S. patent application Ser. No. 17/964,546, filed Oct. 12, 2022, which is hereby incorporated in its entirety.

TECHNICAL FIELD

The present invention pertains generally to purses and hand bags, and more particularly to a protective wrap system for one or more handles of a purse or hand bag.

BACKGROUND OF THE INVENTION

Purses and handbags are a convenient and commonly used device for carrying and transporting personal items. Purses can range in style and in value. A user may have a collection of purses, each serving a different purpose or having a specific style to match an outfit or occasion. One of the first parts to wear on a purse is often the handles. Wear may occur due to the friction of a user's hands on the handles while carrying the purse. In addition, dirt, oils, lotions, or other contaminants from the user's hands can also accumulate on the handles. This can cause discoloring and oxidation of the purse handles. Many purses can be expensive, thus, keeping them in pristine condition is very important not only for aesthetic purposes but also for resale purposes.

Furthermore, when a purse is hung from a surface by the handles, there is a tendency for a purse to slip or fall from the surface. For example, a purse hanging on a user's shoulder may tend to slide or even fall if the user bends down. It is extremely desirable to protect both the purse and its contents from a fall, as damage may occur. It is also desirable to prevent a purse from sliding as this can be a nuisance to the user or disrupt the contents of the purse.

Therefore, a need exists for an invention that will protect the handles of a purse while it is being used, thereby preserving the condition of the purse. There is also a need to protect the purse from sliding or potentially falling when supported by the handles.

BRIEF SUMMARY OF THE EMBODIMENTS

Embodiments disclosed herein are directed to a protective wrap system for use with a purse or other bag having handles, and which both protects the handles and provides a gripping surface to resist any tendency of the purse to slide or slip when supported by the handles. The system includes a wrap configured to wrap around a purse handle and a grip that couples to the wrap and is positioned outside the wrap on the underside of the handle. The system provides protection to the handles from contact with a user's hand or other surface. The system further provides a gripping surface configured to grip a contoured surface without damaging or leaving residue on the surface. The system may be wrapped around two shoulder straps to hold them together and, when carried on a shoulder, prevents the outside strap from slipping off the user's shoulder. The system is also designed to not detract from the aesthetics of the purse.

According to one or more embodiments, a protective wrap system cooperates with a purse having one or more handles. The protective wrap system includes:

a wrap being a planar piece of foldable material including:

an outer surface and an inner surface;

a first fastener located on the outer surface proximate an upper edge and a second fastener located on the inner surface proximate a lower edge, the first fastener configured for engagement with the second fastener;

a central axis located between the upper edge and the lower edge, being substantially parallel to both the upper edge and the lower edge, and having a central axis length that is greater than an edge length of each of the upper edge and the lower edge; and a pair of slits spaced apart along the central axis and oriented substantially orthogonal to the central axis;

a grip formed of flexible material, the grip including:

two ends, each of the two ends configured for insertion through a slit of the pair of slits and having an end width greater than an opening dimension of the slit;

two waists, each of the two waists proximate one of the two ends and having a waist width less than the opening dimension of the slit; and a grip body intermediate the two waists;

wherein, when the two ends of the grip are inserted through the pair of slits of the wrap, the grip body is positioned outside the outer surface of the wrap; and wherein, when the wrap is wrapped around the one or more handles, the inner surface makes contact with the outer surface, thereby allowing the first fastener to be engaged with the second fastener to secure the wrap to the one or more handles.

According to one or more embodiments of the protective wrap system, the wrap includes a plurality of pairs of slits, each pair of slits of the plurality of pairs of slits spaced apart along the central axis and oriented substantially orthogonal to the central axis.

According to one or more embodiments of the protective wrap system, when the two ends of the grip are inserted through the pair of slits of the wrap, the grip body is positionable in offset relation to the outer surface of the wrap.

According to one or more embodiments of the protective wrap system, the wrap system further cooperates with a support having a contoured surface. When the wrap is wrapped around the one or more handles and the one or more handles are placed on the support, the grip body resiliently deforms to contact the contoured surface of the support.

According to one or more embodiments of the protective wrap system, the grip body includes a textured surface.

According to one or more embodiments of the protective wrap system, each of the two ends of the grip has a semi-circular shape.

According to one or more embodiments of the protective wrap system, the grip body has a body width greater than the waist width.

According to one or more embodiments of the protective wrap system, when the two ends of the grip are inserted through the pair of slits of the wrap, the grip body is positioned outside the outer surface of the wrap.

According to one or more embodiments of the protective wrap system, the one or more handles have a length, and the wrap is sized to substantially cover the length of the one or more handles.

According to one or more embodiments, a protective wrap cooperates with a purse having one or more handles, the protective wrap including:

a wrap being a planar piece of foldable material including:

an outer surface and an inner surface;

a first fastener located on the outer surface proximate an upper edge and a second fastener located on the inner surface proximate a lower edge, the first fastener configured for engagement with the second fastener;

a central axis located between the upper edge and the lower edge, being substantially parallel to both the upper edge and the lower edge, and having a central axis length that is greater than an edge length of each of the upper edge and the lower edge; and a pair of slits spaced apart along the central axis and oriented substantially orthogonal to the central axis;

wherein, when the wrap is wrapped around the one or more handles, the inner surface makes contact with the outer surface, thereby allowing the first fastener to be engaged with the second fastener to secure the wrap to the one or more handles; and wherein, when the wrap is wrapped around the one or more handles, the pair of slits are positioned on an underside of the one or more handles.

According to one or more embodiments, the protective wrap further includes a plurality of pairs of slits, each pair of slits of the plurality of pairs of slits spaced apart along the central axis and oriented substantially orthogonal to the central axis.

According to one or more embodiments, the protective wrap includes a first pair of slits of the plurality of pairs of slits being located inwardly from a second pair of slits of the plurality of pairs of slits.

According to one or more embodiments, the one or more handles have a length, and the wrap is sized to substantially cover the length of the one or more handles.

According to one or more embodiments, the first fastener and the second fastener are hook and loop fasteners.

According to one or more embodiments, the first fastener and the second fastener include magnetically attractive materials.

According to one or more embodiments, the protective wrap further cooperates with a grip having two ends, and each slit of the pair of slits is configured for passage of an end of the grip therethrough.

According to one or more embodiments, each slit is configured for passage between the outer surface and the inner surface.

According to one or more embodiments, a grip cooperates with a protective wrap for a purse having one or more handles, the grip including:

two ends each having an end width;

two waists each having a waist width, each of the two waists proximate one of the two ends;

a grip body intermediate the two waists;

wherein the end width of each of the two ends is greater than the waist width of each of the two waists;

wherein the grip is formed of flexible material; and wherein the grip is configured for coupling to the protective wrap with the grip body positioned outside an outer surface of the protective wrap.

According to one or more embodiments, when the grip is coupled to the protective wrap, the grip body is positionable in offset relation to the outer surface of the protective wrap.

According to one or more embodiments, the grip further cooperates with a support having a contoured surface, and, when the grip is coupled to the protective wrap, the protective wrap is wrapped around the one or more handles, and the one or more handles are placed on the support, the grip body resiliently deforms to contact the contoured surface of the support.

According to one or more embodiments, the grip body includes a textured surface.

According to one or more embodiments, each of the two ends of the grip has a semi-circular shape.

According to one or more embodiments, the grip body has a body width greater than the waist width.

According to one or more embodiments, a handle cooperates with a purse having one or more handle fasteners, the handle including:

a planar piece of foldable material including:

an outer surface, an inner surface, an upper edge, and a lower edge; and a central axis located between the upper edge and the lower edge, being substantially parallel to both the upper edge and the lower edge;

a pair of slits spaced apart along the central axis and oriented substantially orthogonal to the central axis; and wherein, the pair of slits are positioned on the outer surface of the planar piece of foldable material.

According to one or more embodiments, the planar piece of foldable material includes two handle ends, each of the handle ends being configured to couple to one of the one or more handle fasteners.

According to one or more embodiments, the planar piece of foldable material includes a plurality of pairs of slits, each pair of slits of the plurality of pairs of slits being spaced apart along the central axis and oriented substantially orthogonal to the central axis.

According to one or more embodiments, the central axis has a central axis length that is greater than an edge length of at least one of the upper edge and the lower edge.

According to one or more embodiments, the central axis length is greater than the edge length of both the upper edge and the lower edge.

According to one or more embodiments, a handle cooperates with a purse having one or more handle fasteners. The handle includes:

a planar piece of foldable material including:

an outer surface, an inner surface, an upper edge, and a lower edge;

a central axis located between the upper edge and the lower edge, being substantially parallel to both the upper edge and the lower edge; and a pair of slits spaced apart along the central axis and oriented substantially orthogonal to the central axis;

a grip formed of flexible material, the grip including:

two ends, each of the two ends configured for insertion through a slit of the pair of slits and having an end width greater than an opening dimension of the slit;

two waists, each of the two waists proximate one of the two ends and having a waist width less than the opening dimension of the slit; and a grip body intermediate the two waists;

wherein, when the two ends of the grip are inserted through the pair of slits of the planar piece of foldable material, the grip body is positioned outside the outer surface of the planar piece of foldable material.

According to one or more embodiments of the handle, the planar piece of foldable material includes two handle ends, each of the handle ends configured to couple to one of the one or more handle fasteners.

According to one or more embodiments of the handle, the planar piece of foldable material includes a plurality of pairs of slits, each pair of slits of the plurality of pairs of slits spaced apart along the central axis and oriented substantially orthogonal to the central axis.

According to one or more embodiments of the handle, when the two ends of the grip are inserted through the pair of slits of the planar piece of foldable material, the grip body is positionable in offset relation to the outer surface of the planar piece of foldable material.

According to one or more embodiments of the handle, the handle further cooperates with a support having a contoured surface. When the planar piece of foldable material is placed on the support, the grip body resiliently deforms to contact the contoured surface of the support.

According to one or more embodiments of the handle, the central axis has a central axis length that is greater than an edge length of at least one of the upper edge and the lower edge. In some embodiments, the central axis length is greater than the edge length of both the upper edge and the lower edge.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

BRIEF DESCRIPTION OF THE DRAWINGS

Non-limiting and non-exhaustive embodiments of the protective wrap system are described with reference to the following figures, wherein like reference numerals refer to like parts throughout the various views unless otherwise specified.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

The detailed description describes non-limiting exemplary embodiments. Any individual features may be combined with other features as required by different applications for at least the benefits described herein. As used herein, the term "about" means plus or minus 10% of a given value unless specifically indicated otherwise. As used herein, the term "substantially the same" means that two items are at least 90% the same.

As used herein, the conjunction "or" is to be construed inclusively (e.g., "A or B" would be interpreted as "A, or B, or both A and B"; e.g., "A, B, or C" would be interpreted as "A; or B; or C; or any two of A, B, and C; or all three of A, B, and C").

As used herein, disclosure of a singular element is also a disclosure of a plural element and vice versa unless otherwise noted.

Figure 1:
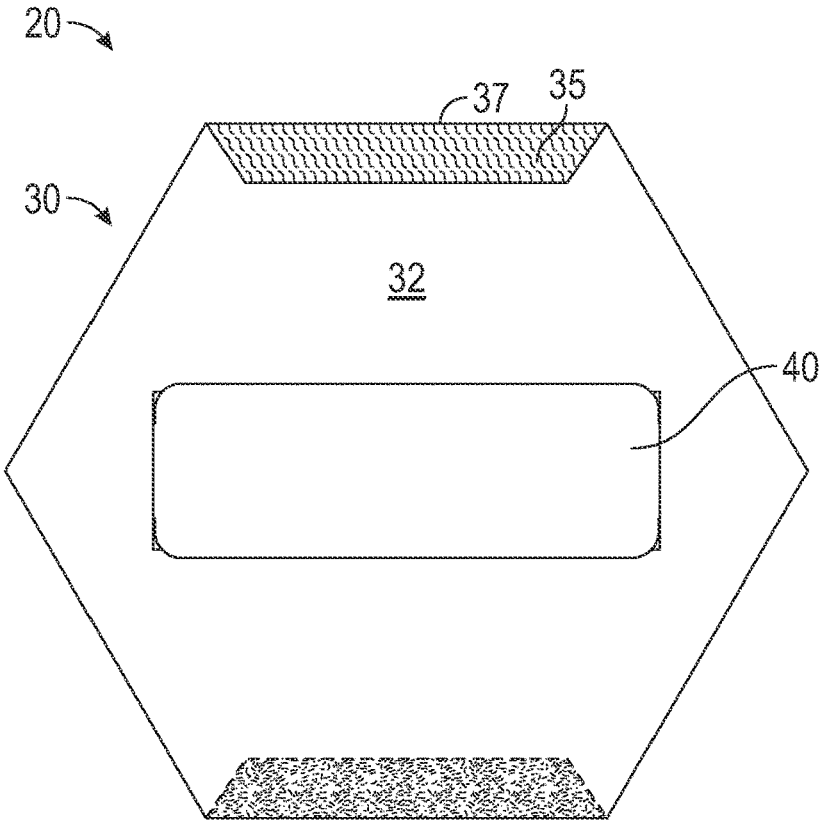
FIG. 1 is a front elevation view illustrating an example embodiment of a protective wrap system.
Figure 2:
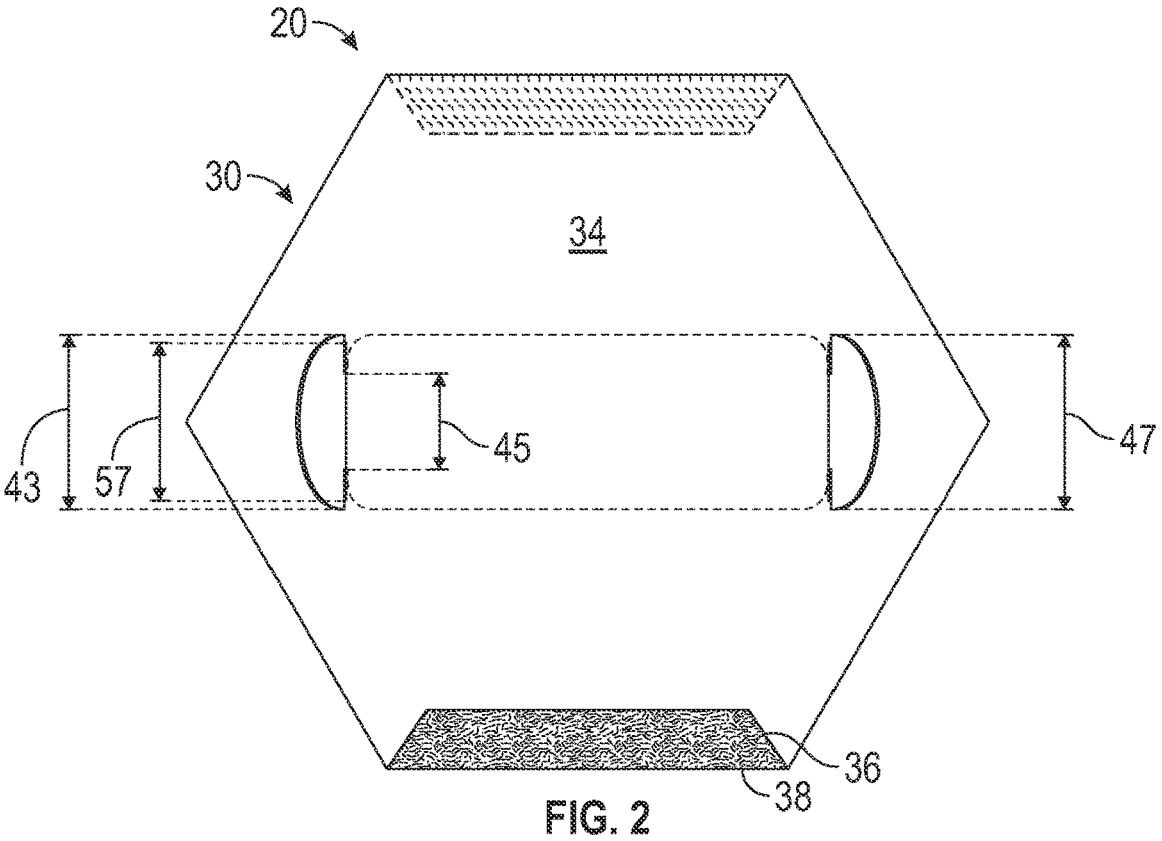
FIG. 2 is a rear elevation view illustrating an example embodiment of the protective wrap system.
Figure 3:
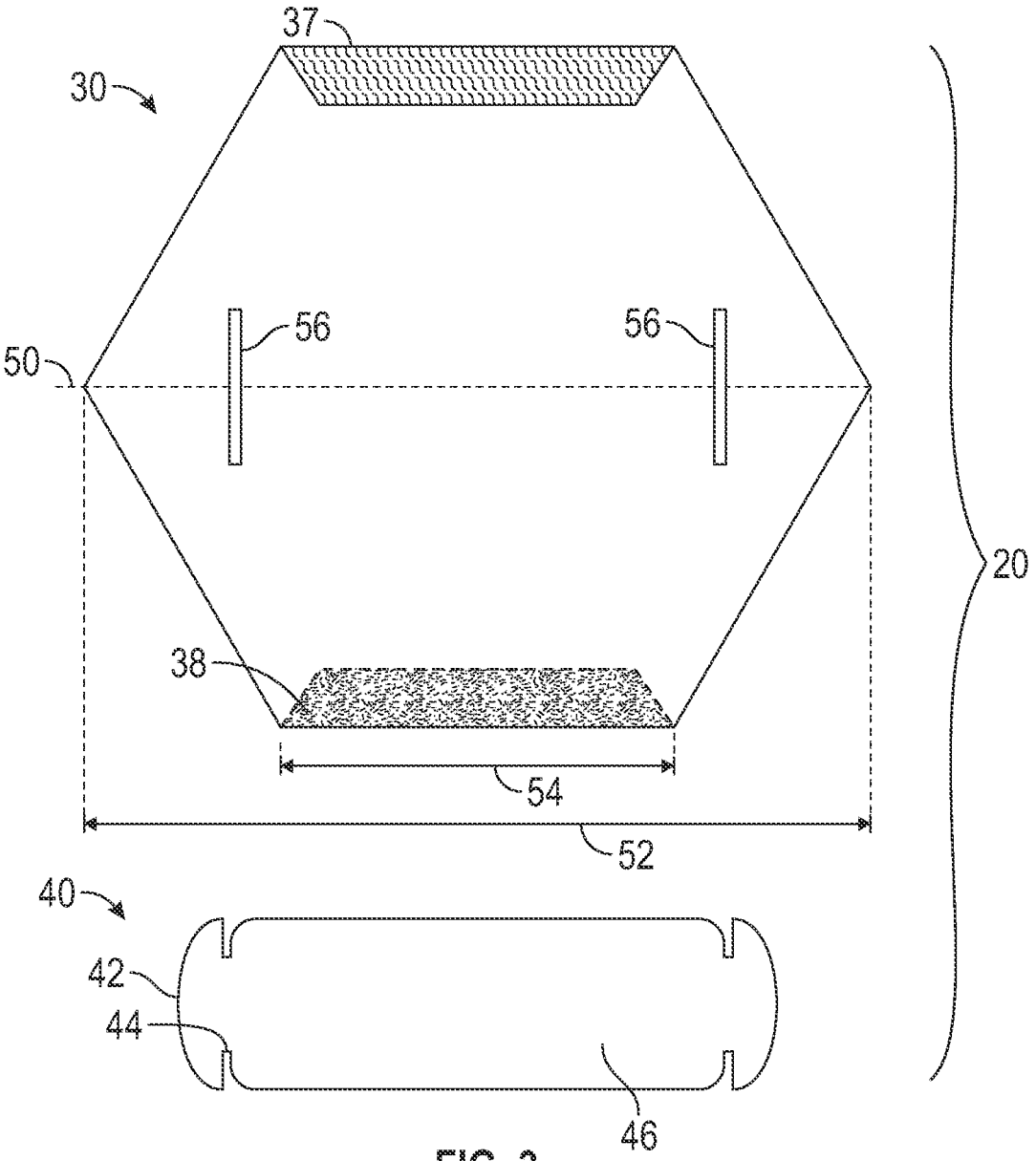
FIG. 3 is an exploded view illustrating an example embodiment of the protective wrap system.

Referring initially to FIGS. 1-3, there are illustrated front and rear elevation, and exploded views, respectively, of an exemplary embodiment of a protective wrap system for a purse, the system generally designated as 20. System 20 includes a wrap 30 and a grip 40 that may be coupled to wrap 30 by inserting each of two ends 42 of grip 40 through a slit 56 of wrap 30. Wrap 30 is a planar piece of foldable material, such as leather, suede, silk, other textiles, or the like. Wrap 30 has an outer surface 32 and an inner surface 34. In general, when wrap 30 is wrapped around a handle, outer surface 32 is exposed while inner surface 34 is oriented toward the handle and is at least partially hidden.

Figure 4:
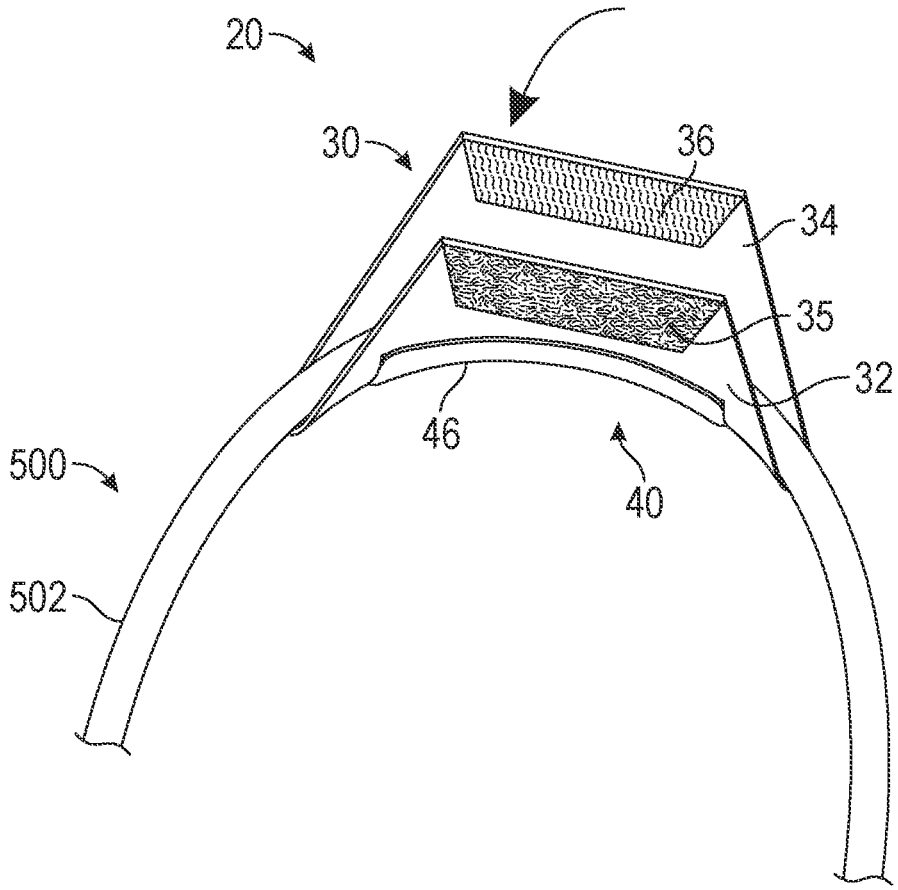
FIG. 4 is a perspective view illustrating an embodiment of the protective wrap system with a cooperating purse.

FIG. 4 is a perspective view illustrating an embodiment of system 20 being used with a cooperating purse 500 (partially shown). Wrap 30 is configured to be wrapped around one or more handles 502 of purse 500 to protect the handles from wear of use or from becoming soiled by transfer of materials, such as natural oils, lotion, dirt, or the like, from a user's hands. When wrap 30 is wrapped around handles 502, inner surface 34 may make contact with outer surface 32 (e.g., by folding in the direction of the arrow), and be secured thereto by a pair of fasteners. For example (see also FIGS. 1-3), a first fastener 35 may be located on outer surface 32 proximate an upper edge 37 of wrap 30 (also shown hidden in dashed lines in the rear view of FIG. 2). A second fastener 36 may be located on inner surface 34 proximate a lower edge 38 of wrap 30 (also shown hidden in dashed lines in the front view of FIG. 1). First fastener 35 is configured for engagement with second fastener 36. In the shown embodiment, first fastener 35 and second fastener 36 are a pair of complementary hook and loop fasteners. In other embodiments, first fastener 35 and second fastener 36 may be, for example, one or more pairs of complementary snaps, one or more pieces of magnetically attractive materials, one or more buttons and button-holes, or similar. In general, first fastener 35 may be engaged with second fastener 36 to secure wrap 30 around one or more handles 502. While first and second fasteners 35, 36 are shown abutting upper and lower edges 37, 38, respectively, fasteners may instead be located near upper and lower edges 37, 38 and offset therefrom.

As shown in FIG. 4, grip 40 has grip body 46 which is positioned outside outer 32 surface of wrap 30, and generally may be located on the underside of handle 502. This location of grip 40 allows the grip to contact a surface that may be supporting purse 500, thereby providing resistance against the purse slipping off of the surface. Grip 40 may be formed of a flexible material, such as silicone. Grip 40 may include adhesive on one or more surfaces. Grip 40 may be formed of a material having weakly adherent properties, such as a material which provides a light resistance to sliding against a surface but does not permanently or strongly adhere or is not likely to leave adhesive residue. Grip 40 may include an at least partially textured surface.

Figure 5:
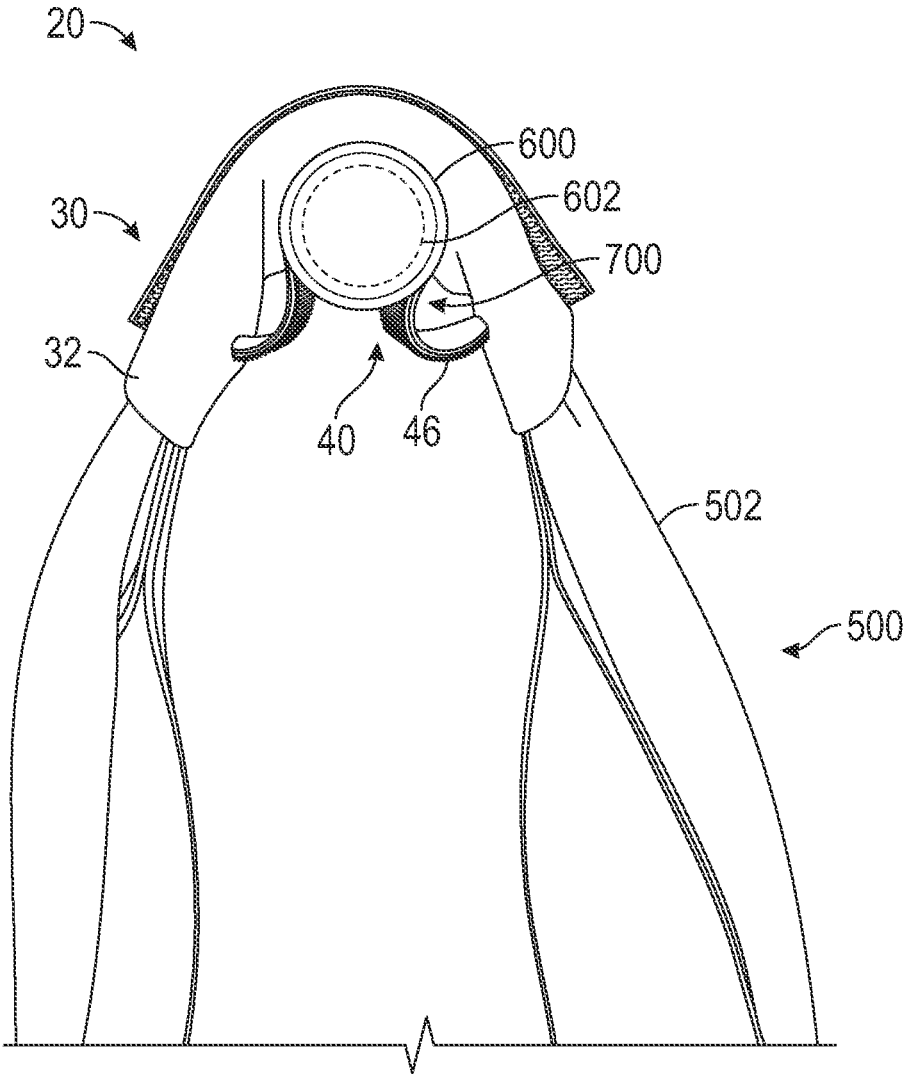
FIG. 5 is a front view illustrating an embodiment of the protective wrap system in a position of use.

FIG. 5 is a front view of an embodiment of system 20, illustrating the system in use with a purse 500 (partially shown) that is hanging from a support 600. Support 600 as shown includes a cylindrical rod 602 (shown hidden in dashed lines). Handles 502 are shown placed on rod 602, and grip body 46 contacts the surface of rod 602. In the shown example, support 600 has a contoured surface (cylindrical rod 602) on which purse 500 is supported by handles 502. Grip body 46 may resiliently deform to contact the contoured surface of support 600. This feature allows the grip to provide a high resistance to slipping. Other examples of a contoured surface which may support a purse and which grip body may contact include a user's shoulder, a chair back, a hook, a knob, and other locations where purses may commonly be hung. To facilitate contact with a contoured surface, grip body 46 may be positionable in an offset relation to outer surface 32 of wrap 30. In other words, grip body 46 may not closely conform to the shape of wrap 30; there may instead be a gap between wrap 30 and grip 40 (note gap 700 in FIG. 5). Grip body 46 of this embodiment is shown with a textured exterior surface.

Referring again to FIGS. 1-3, grip 40 includes two ends 42, a waist 44 proximate each end 42, and grip body 46 located intermediate the two waists 44. Each end 42 has an end width 43, measured as the maximum dimension of end 42 oriented in a direction substantially parallel to slit 56. Slit 56 has an opening dimension 57, measured as the major dimension of the slit. In embodiments, end width 43 is greater than opening dimension 57 of the slit. This feature helps retain the grip in engagement with the wrap. In the shown embodiment, each of the two ends 42 of grip 40 has a semi-circular shape. In other embodiments, the ends may have other shapes, such as a rounded rectangle, or others.

Each waist 44 has a waist width 45, measured as the maximum dimension of waist 44 oriented in a direction substantially parallel to slit 56. In embodiments, waist width 45 is less than opening dimension 57 of the slit. In the shown embodiment, grip body 46 increases in width away from waists 44. In other embodiments, grip body 46 may have about the same width as waists 44. In the shown embodiment, grip body 46 has a body width 47. Body width 47 may be greater than waist width 44.

One or more pairs of slits may be included in wrap 30. FIGS. 1-3 show an embodiment with one pair of slits 56. In embodiments, slits 56 are spaced apart from one another and located along a central axis 50 of wrap 30. Central axis 50 is located between and is substantially parallel to upper edge 37 and lower edge 38 of wrap 30. Slits 56 may be oriented substantially orthogonal to central axis 50.

Figure 6A:
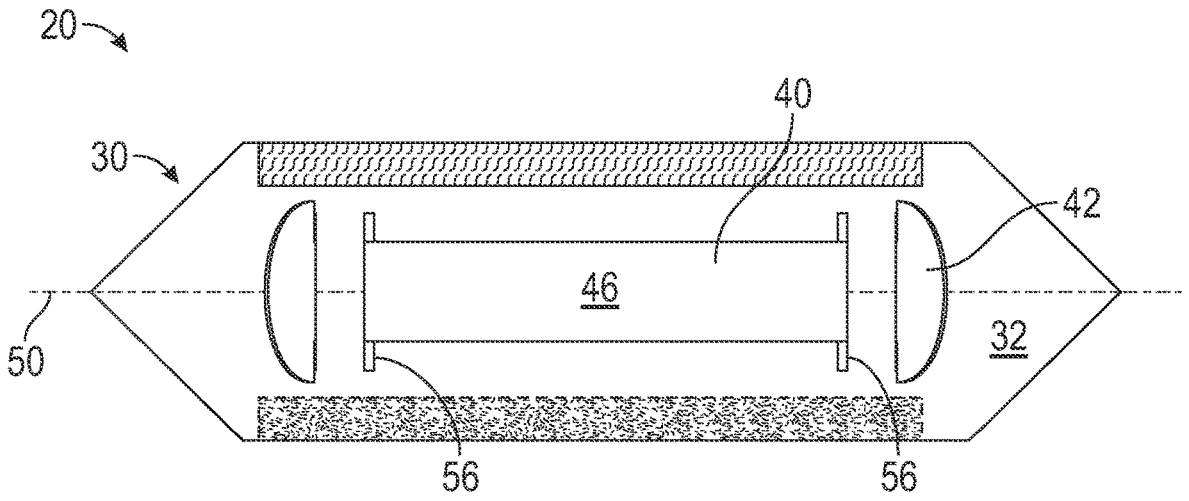
FIG. 6A is a front elevation view illustrating another example embodiment of a protective wrap system.
Figure 6B:
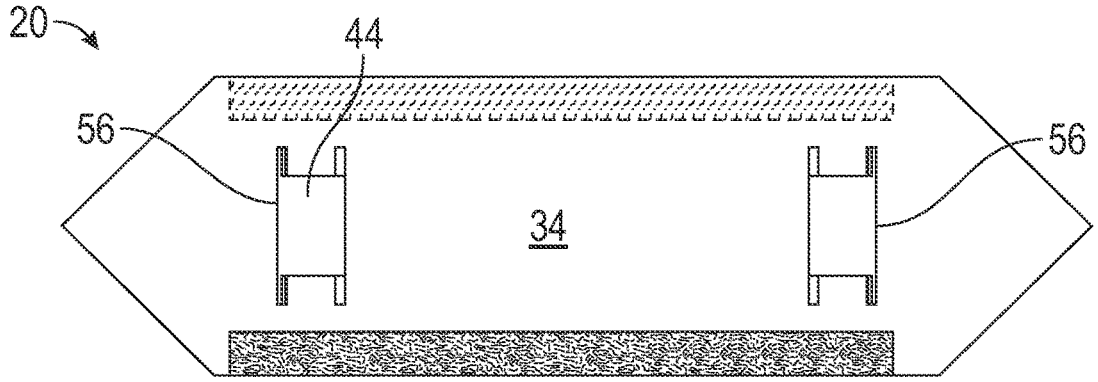
FIG. 6B is a rear elevation view thereof.

FIGS. 6A & 6B are front and rear elevation views, respectively, of another example embodiment of protective wrap system 20. In this embodiment, wrap 30 includes two pairs of slits 56. For example, slits 56 of a first pair of slits may be located adjacent each end 42 of grip 40. A second pair of slits may be located inwardly from the first pair of slits. Each pair of slits is spaced apart from one another and located along central axis 50. All of slits 56 are oriented substantially orthogonal to central axis 50. In this configuration, both grip body 46 and ends 42 are positioned outside of outer surface 32, while only waists 44 are positioned interior to inner surface 34. This configuration may function to increase the available area for the grip to contact a supporting surface, decrease the contact area between the grip and the purse handle, and securely retain the grip within the wrap.

Figure 7:
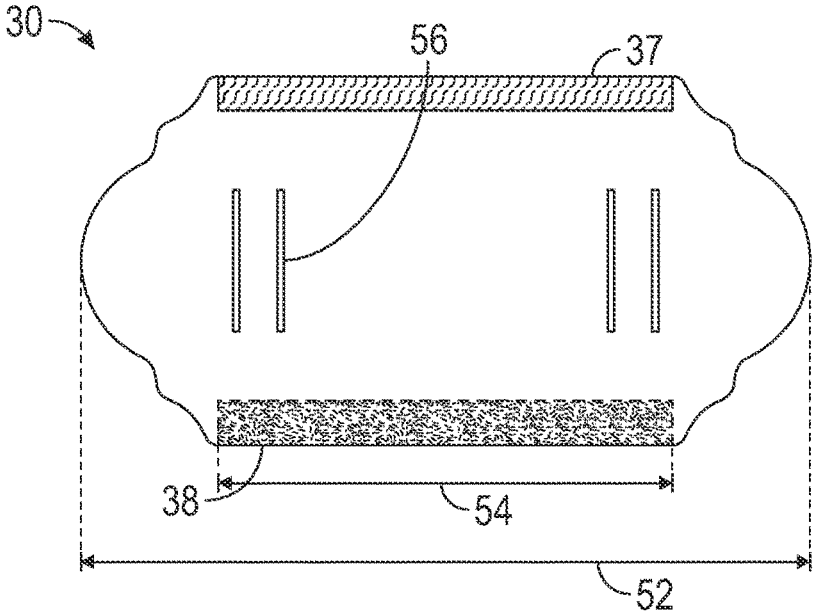
FIG. 7 is a front elevation view illustrating an example embodiment of a wrap of the protective wrap system.
Figure 8:
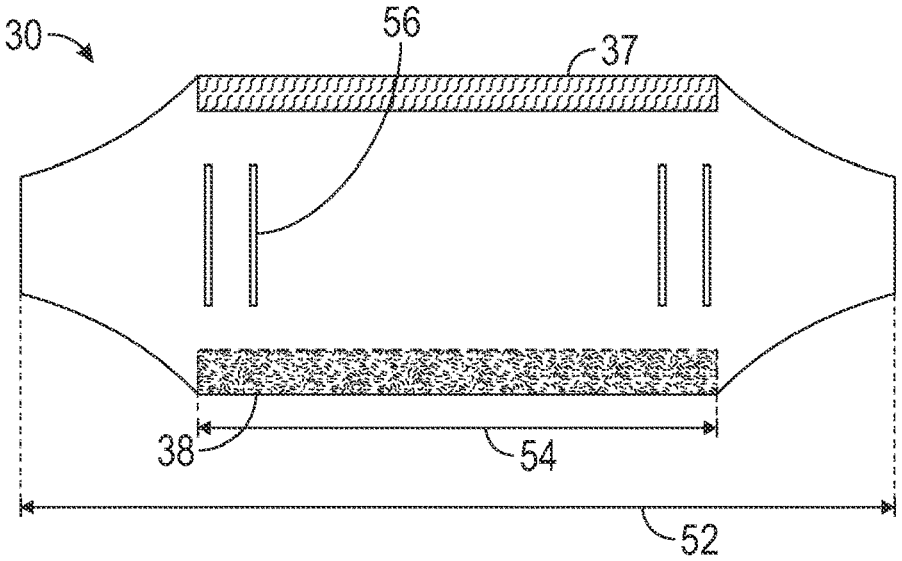
FIG. 8 is a front elevation view illustrating another example embodiment of a wrap of the protective wrap system.
Figure 9:
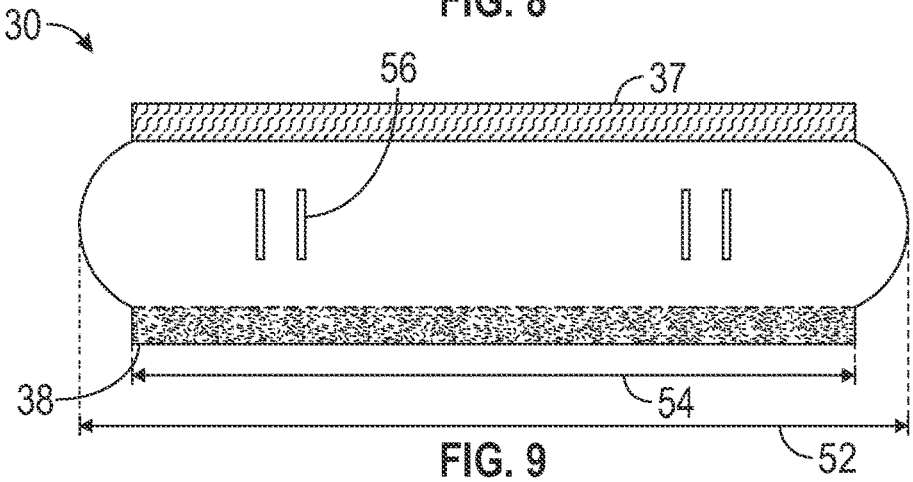
FIG. 9 is a front elevation view illustrating another example embodiment of a wrap of the protective wrap system.

FIGS. 7-9 are a front elevation views illustrating additional example embodiments of wrap 30. Wrap 30 has a central axis length 52 (see also FIG. 3) measured along central axis 50, and an edge length 54 measured along either of upper edge 37 or lower edge 38 (while upper edge 37 and lower edge 38 are shown to have about the same length, in some embodiments they may have different lengths). In each of the shown embodiments, central axis length 52 is greater than edge length 54 of each of the upper edge and the lower edge. This feature provides several advantages. First, having a larger region around the central axis provides maximum coverage to an underside of the purse handle, where a user's hand makes the most contact with the purse handle. Second, there is less material in the region around the upper and lower edges of the wrap, which are located on the top of the purse handle. This makes the wrap less visible and thus does not detract from the aesthetic appearance of the purse.

Wrap 30 and grip 40 may have other geometric shapes than those specifically illustrated herein. Wrap 30 and grip 40 may have various sizes to accommodate various sizes of handles. Wraps and grips may be available in various colors to match the colors or designs of different purses. Grip 40 may include an external covering which matches or complements wrap 30 and/or a specific style of purse. While specific embodiments are discussed herein in relation to a purse, the system may be used in a similar manner on any type of handle.

Figure 10:
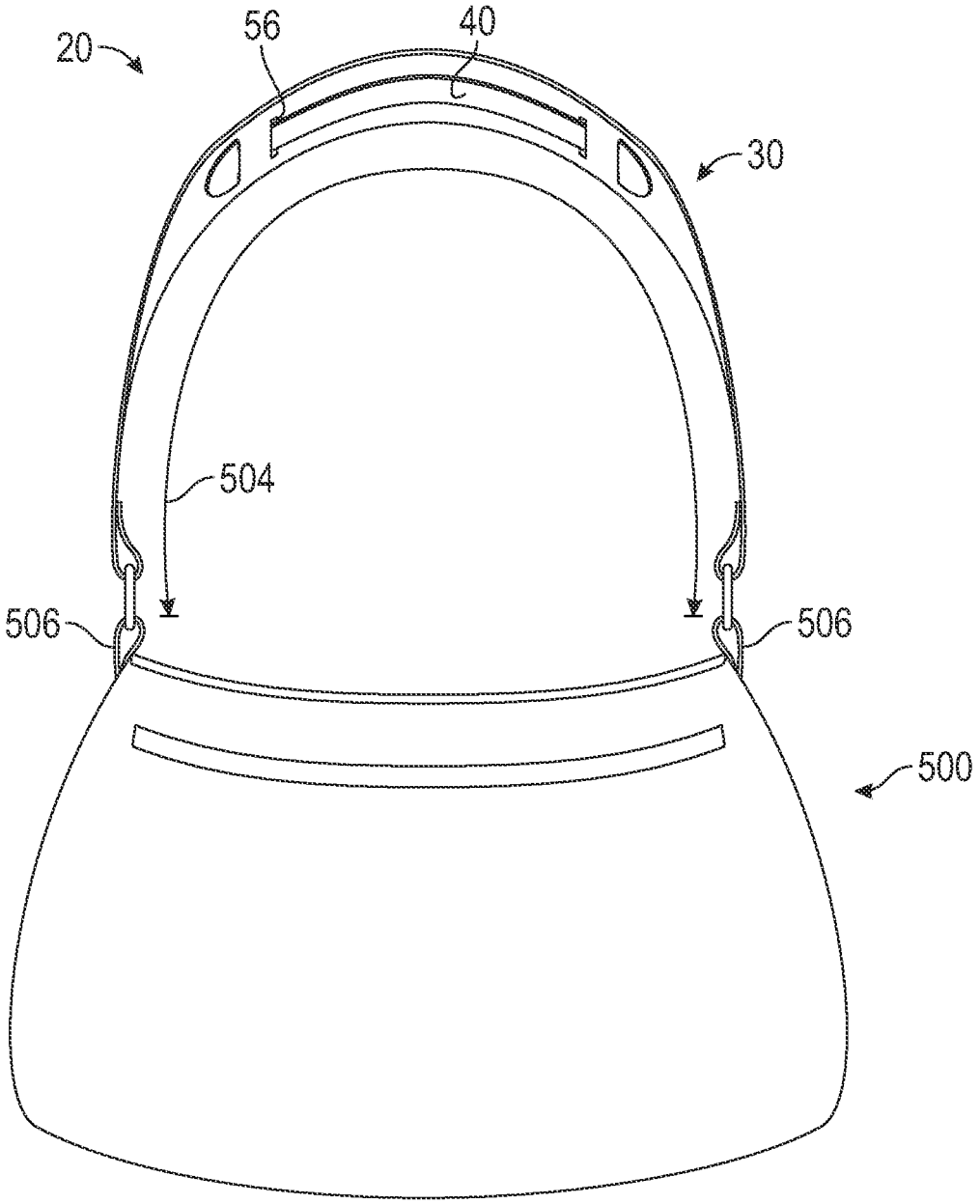
FIG. 10 is a perspective view illustrating another embodiment of the protective wrap system.
Figure 11:
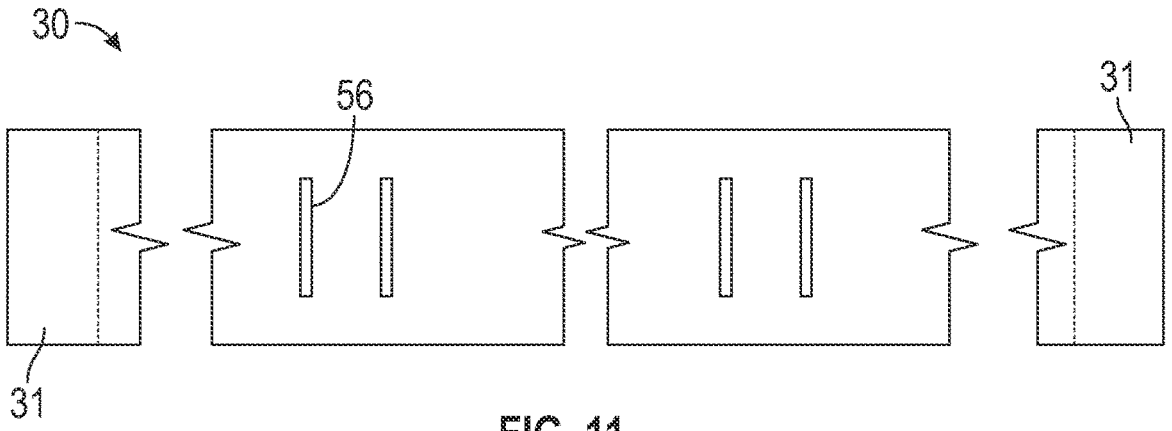
FIG. 11 is a front elevation view illustrating an example embodiment of a wrap of the protective wrap system.

FIG. 10 is a perspective view illustrating another embodiment of system 20, wherein system 20 functions as a handle for a cooperating purse 500. Purse 500 includes one or more handle fasteners 506 (two handle fasteners are provided in the shown embodiment). Handle fasteners may be, for example, a ring, a clip, a loop of folded material, or any other feature suitable for connecting a handle to the purse. FIG. 11 shows wrap 30 of the embodiment of FIG. 10, where the break lines indicate variable length. In general, wrap 30 is of a suitable length to function as a handle for purse 500. In the shown embodiment, wrap 30 includes two pairs of slits 56. Grip 40 is inserted through the pairs of slits as discussed herein. While two pairs of slits are shown, one pair of slits may be used as described herein. For this application, two pairs of slits provides aesthetically pleasing concealment of most of grip 40, which is positioned underneath the outer surface of wrap 30.

Figure 12:
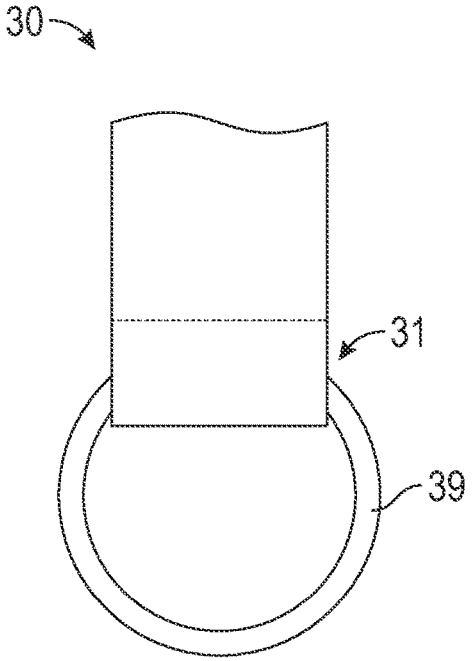
FIG. 12 is an enlarged perspective view of a portion of an embodiment of the wrap.
Figure 13:
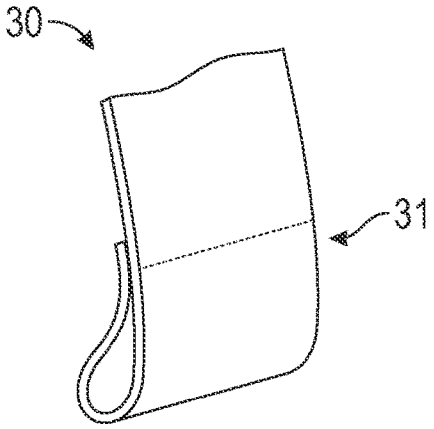
FIG. 13 is an enlarged perspective view of a portion of another embodiment of the wrap.

Wrap 30 may include two handle ends 31 which are configured to couple to handle fasteners 506. FIGS. 12 and 13 show enlarged views of embodiments of a handle end 31. Handle ends 31 may be, for example, a loop of material formed by folding a portion of the wrap material and connecting the folded portion to the wrap (as shown in FIGS. 11 & 13). This type of handle end may couple to a handle fastener 506 that includes a ring or clip. Handle ends 31 may also or instead include a fastener, such as ring 39 shown in FIG. 12. In other embodiments, wrap 30 may have flexible ends which couple to handle fasteners 506 by passing therethrough and tying the wrap to itself.

In some embodiments, handle 502 may have a handle length 504 measured between the locations where handle 502 connects to purse 500. Wrap 30 may be sized to substantially cover handle length 504, or may be sized to cover the majority of cover handle length 504.

The embodiments of the protective wrap system and methods of use described herein are exemplary and numerous modifications, combinations, variations, and rearrangements can be readily envisioned to achieve an equivalent result, all of which are intended to be embraced within the scope of the appended claims. Further, nothing in the above-provided discussions of the system and method should be construed as limiting the invention to a particular embodiment or combination of embodiments. The scope of the invention is defined by the appended claims.

What is claimed is:

1. A protective wrap for cooperation with a purse having one or more handles and further cooperating with a grip having two ends, the protective wrap comprising:

a wrap being a planar piece of foldable material including:

an outer surface and an inner surface;

a first fastener located on the outer surface proximate an upper edge and a second fastener located on the inner surface proximate a lower edge, the first fastener configured for engagement with the second fastener;

a central axis located between the upper edge and the lower edge, being substantially parallel to both the upper edge and the lower edge, and having a central axis length that is greater than an edge length of each of the upper edge and the lower edge; and a pair of slits spaced apart along the central axis and oriented substantially orthogonal to the central axis, each slit of the pair of slits configured for passage of an end of the grip therethrough;

wherein, when the wrap is wrapped around the one or more handles, the inner surface makes contact with the outer surface, thereby allowing the first fastener to be engaged with the second fastener to secure the wrap to the one or more handles; and wherein, when the wrap is wrapped around the one or more handles, the pair of slits are positioned on an underside of the one or more handles.

2. The protective wrap of claim 1, further including a plurality of pairs of slits, each pair of slits of the plurality of pairs of slits spaced apart along the central axis and oriented substantially orthogonal to the central axis.

3. The protective wrap of claim 2, wherein a first pair of slits of the plurality of pairs of slits is located inwardly from a second pair of slits of the plurality of pairs of slits.

4. The protective wrap of claim 1, the one or more handles having a length, wherein the wrap is sized to cover a majority of the length of the one or more handles.

5. The protective wrap of claim 1, wherein the first fastener and the second fastener are hook and loop fasteners.

6. The protective wrap of claim 1, wherein the first fastener and the second fastener include magnetically attractive materials.

7. The protective wrap of claim 1, wherein each slit is configured for passage between the outer surface and the inner surface.

8. A grip for cooperation with a protective wrap for a purse having one or more handles, the grip comprising:

two ends each having an end width;

two waists each having a waist width, each of the two waists proximate one of the two ends;

a grip body intermediate the two waists;

wherein the end width of each of the two ends is greater than the waist width of each of the two waists;

wherein the grip is formed of flexible material; and wherein the grip is configured for coupling to the protective wrap with the grip body positioned outside an outer surface of the protective wrap.

9. The grip of claim 8, wherein, when the grip is coupled to the protective wrap, the grip body is positionable in offset relation to the outer surface of the protective wrap.

10. The grip of claim 8, further cooperating with a support having a contoured surface, wherein, when the grip is coupled to the protective wrap, the protective wrap is wrapped around the one or more handles, and the one or more handles are placed on the support, the grip body resiliently deforms to contact the contoured surface of the support.

11. The grip of claim 8, wherein the grip body includes a textured surface.

12. The grip of claim 8, wherein each of the two ends of the grip has a semi-circular shape.

13. The grip of claim 8, wherein the grip body has a body width greater than the waist width.

* * * * *